United States Patent [19]

Krauthamer

[11] Patent Number: 4,984,489

[45] Date of Patent: Jan. 15, 1991

[54] WINDOW HANDLE TURNING ACCESSORY

[76] Inventor: Martin Krauthamer, 65 Beverly Rd., Great Neck, N.Y. 11021

[21] Appl. No.: 421,134

[22] Filed: Oct. 13, 1989

Related U.S. Application Data

[63] Continuation of Ser. No. 320,698, Mar. 8, 1989, abandoned.

[51] Int. Cl.[5] ..... B25B 13/00

[52] U.S. Cl. ..... 81/124.2; 81/121.1

[58] Field of Search ..... 81/124.2, 121.1, 125, 81/15.9

[56] References Cited

U.S. PATENT DOCUMENTS

| | | | |
|---|---|---|---|
| 3,411,555 | 11/1968 | Herpich | 81/121.1 |
| 4,357,845 | 11/1982 | Cornia | 81/125 |
| 4,788,893 | 12/1988 | Sutton | 81/15.9 |

*Primary Examiner*—Frederick R. Schmidt
*Assistant Examiner*—Lawrence Cruz
*Attorney, Agent, or Firm*—Levisohn, Lerner & Berger

[57] ABSTRACT

An accessory for a hand drill which cooperates with the crank handle of the opening mechanism of a casement window. The accessory, when turned by the drill, facilitates turning of the crank handle and opening or closing of the window. The accessory includes a shaft which is intended to be gripped by the chuck or jaws of the hand drill in much the same manner that hand drills grip drill bits. A forwardly projecting crank handle-contacting head is provided which is adapted to slide over the crank handle. The head has a side opening with a pair of edges which push against one side of the crank handle in order to rotate the same. Preferably, the inside surface of the head of the accessory and the crank handle's contacting edges are rubber coated so that rotation of the accessory and its movement with respect to the crank handle will not mar the finish of the crank handle. In an alternate embodiment, the head can be adapted for rotation of the splines of the window turning mechanism exposed when the handle is fully removed. In yet another alternate embodiment, a head is provided which is adjustably configured to receive different sized crank handles.

5 Claims, 3 Drawing Sheets

FIG. 1
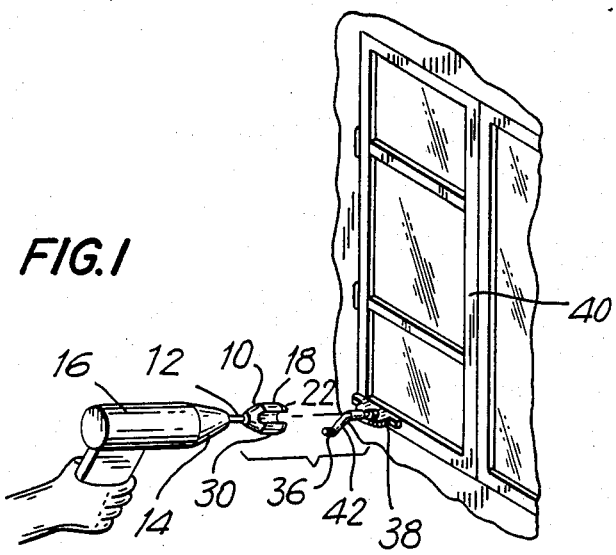
FIG. 3
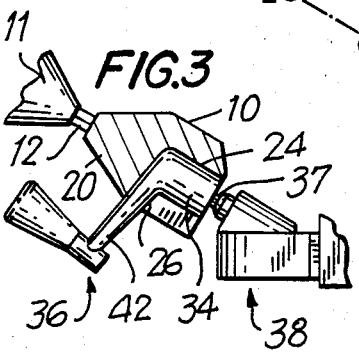
FIG. 2
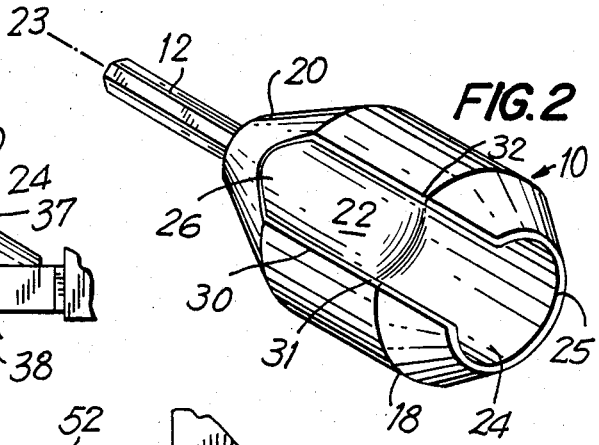
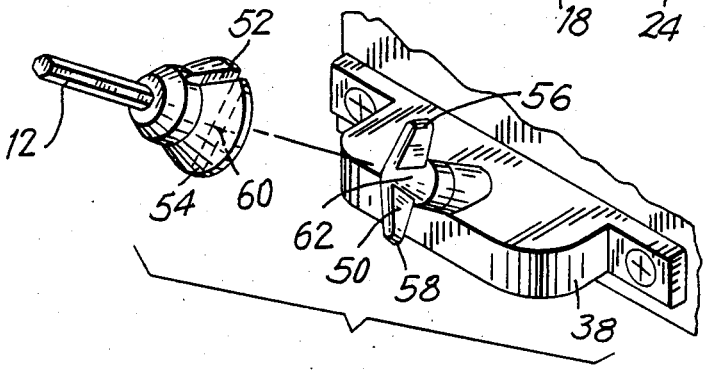
FIG. 4

WINDOW HANDLE TURNING ACCESSORY

This application is a continuation of application Ser. No. 07/320698 filed Mar. 8, 1989, which has been abandoned.

BACKGROUND OF THE INVENTION AND DESCRIPTION OF THE PRIOR ART

The present invention relates to an accessory for use with a hand drill. Preferably, the hand drill is of the cordless or battery-operated type. The accessory is intended to facilitate the turning of the crank handle of the opening mechanism of casement-type windows so they are easier to open and close. This accessory would be used by the elderly or those having arthritic conditions and it would facilitate their ease of opening and/or closing of casement type windows since it is now difficult for these people to turn, manually, the crank handles of these opening mechanisms. Often these crank handles are not properly greased or have become sufficiently rusted that operation and opening or closing of the windows is extremely difficult.

In addition, the accessory would have instant appeal to vacation or second home owners who frequently leave their homes shut tight when they are in their primary residence and, upon arriving and "opening up" the house, it is highly desirable for all windows to be quickly opened to allow fresh air to come in. This device would accomplish that in a minimum of time with respect to manual turning of the handle cranks of these casement-type windows. Also, clearly, when it is time for the vacation or second homeowner to "close up" the vacation or second home, prior to leaving, the accessory, again, could be a very simple and quick manner of accomplishing the closing of all windows, rather than manually hand cranking them all to the closed position.

Portable hand drills of the electric cordless-type have recently become extremely popular and are primarily used as portable screwdrivers. These devices have a relative high torque to weight ratio. After use, they are stored for subsequent use in a battery recharger which is connected to a source of household electric current. As mentioned, the principle use of these portable drills is for use as a screwdriver and, therefore, the drill is often provided with a chuck or jaw mechanism for holding alternative drill bits in the form of Phillips-head screwdriver tips or flat head screwdriver tips, all in addition to ordinary drill bits. Irrespective of the shape of the driving head which is inserted into the chuck or jaws of the portable drill, the drill connecting shank is generally a metal hex-shaped rod or bar. A locking mechanism is frequently provided for insuring that the hex-shaped shank is secured into the chuck of the portable drill.

The present invention relates to a new and extremely useful accessory for a portable hand drill or screwdriver which facilitates the quick and easy turning of the crank handle of the opening mechanism of a casement-type window. The accessory can be easily inserted and locked into the portable drill and, then, the head of the accessory can be easilY slipped into place over the crank handle. When it is desired to either open or close the casement window, after the head of the accessory is placed or slipped over the lateral extension of the crank handle, the trigger or other actuator of the hand drill is depressed and the torque power of the hand drill rotates the head of the accessory which, in turn, causes the crank handle to rotate about its turning axis to thereby operate the opening mechanism of the casement window. Typically, these portable hand drills or cordless screwdrivers are provided with a "reverse" switch so that the present accessory can be used to either open or close the casement type window, as desired.

SUMMARY OF THE INVENTION

An accessory for a portable screwdriver or hand drill is provided for facilitating the easy opening and closing of the opening mechanism of casement-type windows which are provided with mechanical hand-crank handles. The accessory is provided, on one end, with an ordinary hex-shaped shaft which is adapted to be received and held within the chuck or movable jaws of the portable screwdriver or hand drill. The head end of the accessory is, preferably, generally cylindrically or conically shaped so as to be received over the cylindrical portion of the crank handle of the opening mechanism of the casement window i.e., that portion of the handle which overlies and surrounds the turning axis of the opening mechanism. A side opening or lateral slot is also provided in the head end extending outwardly from the center opening which allows the device to be slipped over the handle from a side. The side opening also allows the lateral extension of the hand crank to be "gripped" for turning. The side opening allows for easier placement of the device over the crank handle since axial alignment between the head and the center turning axis of the opening mechanisms is eliminated. Rather, the device can be mounted over the crank handle by radial or lateral movement of the head with respect to the turning axis.

The edge of the side opening or lateral slot is intended to contact one side of the lateral extension of the hand crank and, therefore, when the hand drill or portable screwdriver is energized to rotate the shank of the accessory, the head rotates and the edge of the side opening will contact one side of the lateral extension of the hand crank and cause it to rotate thereby driving the opening mechanism of the casement-type window in the desired direction. By having the edge contact the lateral extension of the crank handle and not relying on direct turning of the center portion of the crank handle the mechanical advantage provided by the crank handle is used to advantage for these portable, lightweight devices.

Preferably, according to the preferred embodiment of the present invention, the inside surface of the head end of the accessory is rubber coated so that repeated use of the device on the metal hand cranks will not mar their outside surface or finish. Also, the edges of the side opening which contact the lateral extension of the hand crank are also preferably rubber coated, again, to prevent surface damage after repeated use.

It is thus a principle object of the present invention to provide an accessory device for a portable hand drill or battery operated screwdriver or, of course, any drill powered by any means which facilitates the quick and relatively effortless opening and closing of a casement type window having a crank handle opening mechanism.

It is a further object of the present invention to provide a device for opening and closing a casement-type window having a mechanical hand crank opening mechanism without requiring significant manual strength or dexterity to accomplish the same.

It is yet a further object of the present invention to provide an accessory device for opening and closing a casement type window without marring the surface of the handles of the opening mechanism of the casement-type windows.

It is also an object of the present invention to provide a device which is capable of rotating the opening mechanism of a casement-type window even with the turning crank handles removed. The device eliminates the need for the presence of the handles which detract, aesthetically from the appearance of the windows. Removal of the handle is also desirable so as to allow window shades or blinds to not be interfered with.

It is also an object of the present invention to provide a single head which, by adjustable mechanisms is capable of adapting to various sized opening mechanisms and associated crank handles.

It is also an object of the present invention to allow the device to be slipped over the crank handles from a side or by axial alignment between the turning axis of the crank handle and the head of the device.

These and additional objects, if not set forth specifically herein, will be readily apparent to those of ordinary skill in the art from the detailed description provided herein below when considered and understood in conjunction with reference to the accompanying drawings.

BRIEF DESCRIPTION OF THE DRAWINGS

FIG. 1 is a perspective view of the present invention, secured in the chuck of a portable hand drill and about to be inserted over the crank handle of an opening mechanism of a casement-type window;

FIG. 2 is a perspective view of the present invention in its preferred embodiment;

FIG. 3 is a cross-sectional view of the device of the present invention, connected to a hand drill, partially shown, with the head end of the device positioned on the crank handle of the opening mechanism of a casement-type window;

FIG. 4 is a perspective view of an embodiment of the present invention, shown detached from a hand drill, yet shown for use in connection with a "butterfly" shaped crank handle secured to the same opening mechanism of a casement-type window as shown in FIG. 1;

DETAILED DESCRIPTION OF DRAWINGS AND THE PREFERRED EMBODIMENT

Figure 5:
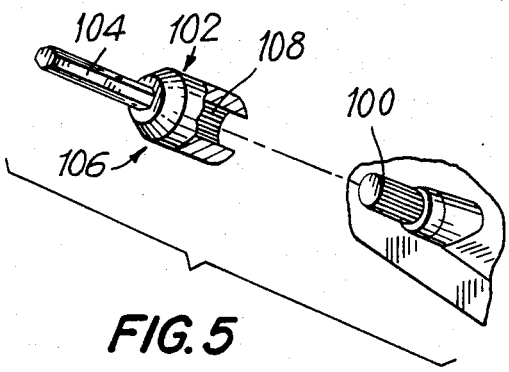
FIG. 5 is a partial exploded view of an alternative embodiment of the present invention, detached from a portable hand drill, and capable of being used on the exposed splines of the opening mechanism (partially shown) of a casement-type window, after the handle has been removed, whether the handle is of the crank or butterfly-shape.

With reference to the Figures, an accessory for a portable hand drill or battery operated screwdriver is provided for facilitating the opening and closing of a casement-type window which is provided with the normally and conventionally used crank handle opening mechanism. The device, generally referred to as 10, comprises a hex-shaped shank portion 12 and a head end 18. The shank portion 12 is adapted to be selectively received and held in the chuck mechanism or jaws, generally referred to as 14, of a portable hand drill or battery powered screwdriver mechanism 16. As best shown in FIG. 1, the portable hand drill 16 can be gripped by the user and a trigger (not shown) can be selectively depressed to rotate the chuck mechanism 14 which, in turn, serves to rotate shank 12 of the accessory or device 10. The torque power of the hand drill 16 is transferred to the accessory 10 and is generally sufficient to rotate the device 10 and, in turn, when the device is placed over the crank handle of the opening mechanism of a casement-type window, the handle, too, will rotate which, in turn, causes the opening mechanism of the casement-type window to open or close the window, as desired, depending upon the direction of rotation of the screwdriver and the secured device.

The head end 18 extends forwardly from the shank 12 and is generally of a cylindrical or conical configuration. Preferably, the head is made from either a hard plastic, like Delrin or, alternatively, it can be machined from metal as, for example, aluminum or stainless steel. The head end 18, while generally cylindrical has a rear section 20 which is cone shaped. The shank 12 can be either integrally formed with head end 18 or, alternatively, the shank can be inserted into and then glued to section 20.

A center opening 22, generally cylindrical, is molded or machined into the head end 18. The longitudinal axis of center opening 22 is aligned with the rotative axis 23 of the device as defined by shank 12. The center opening has a front end 25. The center opening 22 consists of a first partial cylindrical hollow section 24 and an inclined section 26 (See FIGS. 2 and 3) which intersects cylindrical section 24 and forms a continuous surface corresponding to the shape of the crank handle. A side opening 30 is formed at the outside surface of the head end 18 to allow the device to be laterally placed over and removed from a crank handle.

The interior of the head end 18 is preferably coated with rubber so that when it is secured over the crank handle of the opening mechanism of a casement-type window it will not mar the surface or finish thereof. The edges 31 and 32 (See FIG. 2) of the side opening 30 are also rubber coated so that when they contact the sides of the crank handle during rotation again, no marring of the surface or finish will result.

The diameter of the cylinder section 24 of the head end 18 is sufficient so that it can be easily received over the cylindrical connecting portion 34 (See FIG. 3) of crank handle 36 of the opening mechanism 38 of a casement window 40. The inclined section 26 of the head end 18 is angled with respect to the cylindrical section 24 and is substantially the same angle of inclination that the lateral extension 42 of crank handle 36 defines with respect to the cylindrical connecting portion 34 of crank handle 36. The width of the side opening 30 is sufficiently wide so that the device can be placed over the lateral extension 42 of the crank handle 36 and easily removed, after use.

The side opening eliminates the need for precise axial alignment between the device and the crank handle on which it is to be placed. The width of the side opening is greater than or equal to the diameter of the cylindrical connecting section of the handle so that the device can be easily slid onto and off of the handle from the side, thereby avoiding the requirement of axial alignment. Thus, the side opening is equal to or greater in width than the diameter of the center opening 22.

In operation, the accessory 10 is located and locked into the chuck mechanism 14 of the portable hand drill or battery operated screwdriver 16. This is performed, as mentioned, by having the shank 12 of the accessory 10 secured within the chuck mechanism or movable jaws 14, in a well known and conventional manner. The head end 18 of the accessory 10 is then laterally or axially slid over the crank handle 36 (but not necessarily axially) so that the cylindrical connecting portion 34 of the crank handle is located within the cylinder section 24 of the device while the lateral extension 42 of the crank handle 36 is located within the inclined section 26. The lateral extension 42 of the crank handle exits from the head end through the side opening 30. This is shown in FIG. 3. Thus, the lateral extension 42 of the crank handle passes through the side of the head end 18 and the interior of the head end is held against the lateral extension of the crank handle since inclined section 26 is positively located against the lateral extension 42. Then, the operator can depress the trigger mechanism of the hand drill 16 and, in this manner, rotation of the shank 12 of the accessory causes the head end 18 to correspondingly rotate. This, in turn, causes one of the edges 31 or 32 (depending upon the direction of rotation of the shank and head end) to contact one of the sides of the lateral extension 42 of the crank handle and, in this manner, the power or torque transmitted by the hand drill is transferred through the head end and this causes the crank handle 36 to rotate about its rotation axis 37. This in turn, causes the opening mechanism 38 to operate either in the opening or closing direction to thereby cause the casement window 40 to open or close. The internal mechanical gearing of the opening mechanism 38 is not a part of the present invention and need not be described herein in that it is well known and conventional.

An alternate embodiment of the present invention is illustrated in FIG. 4. Similar parts to the embodiment shown in FIGS. 1–3 have been numbered the same as the first embodiment. Here, however, the crank handle 36 of the opening mechanism 38 has been replaced by a butterfly handle 50. The opening mechanism 38 is identical to that shown for the casement window 40. In this embodiment, however, the head end 18 of the device 10 has a pair of opposed side openings 52 and 54. These allow the two wings 56 and 58 of the butterfly handle 50 to exit through the head end. The head end has a central conical section 60 which is adapted to fit over the central hub 62 of the butterfly handle 50. In this embodiment, the edges of the two side openings 52 and 54 will contact the sides of the wings 56 and 58 of the butterfly handle 50. This embodiment requires axial alignment between conical section 60 and the central hub 62 of the handle to put the device in its proper position ready for use.

After the casement window 40 has been opened or closed by the accessory device 10, it is rather simple for the user to merely withdraw the drill, with the accessory attached thereto, from the crank handle 36 or 50 and the user can then go on to the next window for opening or closing. Of course, if all windows have been opened or closed, as desired, the drill, with device secured or detached, can be stored in the battery charging holder for subsequent use.

An alternate embodiment of the invention is shown in FIG. 5. Here, however, the crank handle 36 has been removed from the opening mechanism to thereby expose the splines 100. The head 102 of the device 106 is, of course, secured to the hex-shaped shank 104 in the same manner as described with respect to the embodiment shown in FIGS. 1 and 2. The head of this embodiment, however, is not provided with a lateral opening but, rather, axial alignment between head and splines 100 is required to place the head end over the splines 100. The inside surface of the head end 102 is provided with internal, parallel grooves and ridges 108 which are matingly engagable with splines 100. This embodiment of the invention is used in the same manner as previously discussed with respect to the other embodiments.

Figure 6:
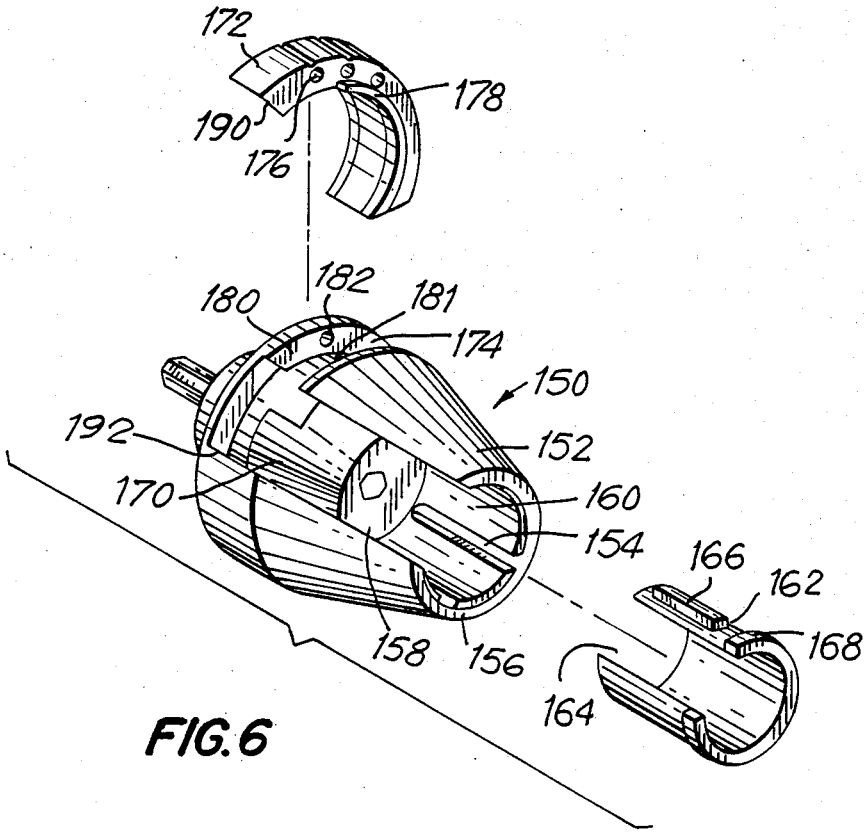
FIG. 6 is an exploded view of yet another embodiment of the present invention, this embodiment having interchangeable inserts and a sliding ring portion so as to allow a single such device to be adjustably configured for use on various shaped and sized crank handles and/or the exposed splines (handles removed) of the opening mechanism of a casement type window.

FIG. 6 shows yet another embodiment of the present invention. A single device 150, shown therein, is capable of being used on a plurality of crank handles, each of which has a different sized cylindrical connecting portion 34 and width of lateral extension 42. This embodiment can also be used with the exposed splines 100. In this embodiment, the head end 152 is machined or molded with two or more internal grooves 154. The grooves extend from the front edge 156 to the bottom 158 of the cylindrical section 160. An insert 162 preferably brass, is insertable and removable from the head end 152 of the device. The insert 162 is generally cylindrical and hollow with a side opening 164. The exterior of the insert 162 is provided with two or more bar-like projections 166 which are of a size and configuration to be frictionally held, by sliding into the grooves 154 of the head end 152, and, yet, with force, selectively removed. The front of the insert 162 has an outwardly extending lip or ridge 168. When the insert is installed into the head end 152 of the device 150, the bar-like projections 166 will be received by and held in the grooves 154 and the lip or ridge will limit or block the insert 162 from going too deeply into the head end in that it will abut against the front edge 156. The thickness of the insert and the size of the side opening 164 determine the snugness of fit between the device and a crank handle. Various inserts 162 can be provided and sold along with a single head 152 to fit onto various sized crank handles. The use of selectively insertable and removable inserts, of various internal sizes, with different dimensioned side openings, yet all with a standard exterior circumference having bar-like projections 166 increases the versatility of the device.

The side opening 170 of the head end allows for the lateral and angled extension of the handle to be captured and held by the device. A sliding ring portion 172 is adjustable rotated in a circumferential groove 174 cut into or molded into the head end. The sliding ring portion 172 has a plurality of holes 176 passing from edge to edge. A pair of flanges 178 facilitate relative movement of the sliding ring portion 172 and yet prevent accidental removal of the ring portion from the head end. Flanges travel in grooves located at the opposed planar surfaces 180 and 181 of circumferential groove 174. To facilitate assembly, the circumferential groove 174 has an enlarged rear opening which is capable of receiving the ring 172 with its outwardly extending flanges 178. A hole 182 passes completely through the top of the head end and exit through top planar surface 180. In addition, a hole 184 (not visible in the drawings) is drilled into bottom planar surface 181, the holes 182 and 184 being aligned.

In use, the sliding ring is rotated within to the circumferential groove 174 until the hole 176 is aligned with the pair of holes 182 and 184 such that the lateral extension of the handle is snugly held between edge 190 of the ring and the far wall 192 of the lateral opening 170. Then, a pin 194 (not shown) is passed downwardly through hole 182 of top planar surface 180, through hole 176 of ring 172 and then into hole 184 of bottom planar surface 181. The ring is thus held in relative position by the pin and the device thus is capable of adapting to a variety of sizes of crank handles. After initial set-up of the position of the sliding ring and the proper sized insert 162, the device is used in the same manner as that shown in FIGS. 1–3, until further adjustment is required.

Alternatively, the insert 162 can have a set of internal grooves and teeth to matingly engage with the exposed splines 100 of the opening mechanism. This, then, allows the device 150 to be used in much the same manner as that shown in FIG. 5.

Figure 7:
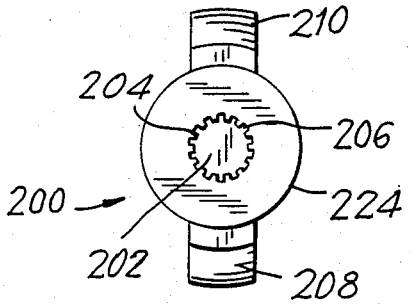
FIG. 7 is a front plan view of a spline covering knob.
Figure 8:
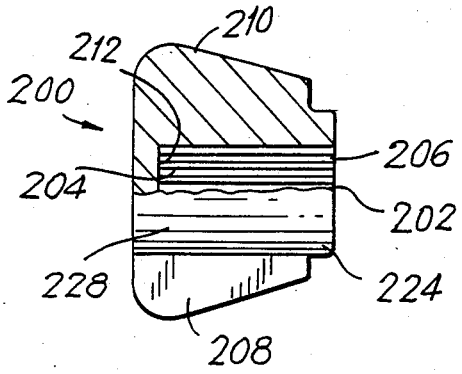
FIG. 8 is a partial cross-sectional view of the spline covering knob shown in FIG. 7.
Figure 9:
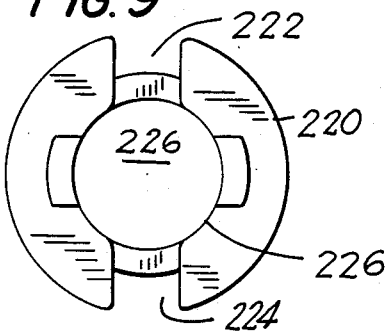
FIG. 9 is a front plan view of a different embodiment of the invention, capable of use with the spline covering knob.

Yet another embodiment of the invention is shown in FIGS. 7–9. The spline covering knob 200 (basically a specially designed knob or cap) consists of a general cylinder shape having a pair of outwardly extending turning wings or "ears". The cylinder has a cavity 202 with internal, alternating teeth 204 and valleys 206. The teeth and valleys are matingly engagable with the exposed splines 100 (See FIG. 5) of the casement window opening mechanism after the crank handles has been removed. A pair of turning ears 208 and 210 facilitate turning of the spline covering knob 200. They allow easy manual turning of the exposed spline portion 100 of the window opening mechanism, after the crank handle has been removed and the knob installed thereover. The cavity 202 has a rear end wall 212 which limits the degree of downward travel of the spline covering knob 200 on the exposed splines 100 even as the knob is turned. It must be appreciated that the spline covering knob is not intended to clamp down or provide downward force (contrast a wing nut) but, rather, it allows a window turning mechanism, with crank handle removed, to be manually turned, by use of the outwardly extending ears and, yet, an open head 220 (See FIG. 9) can be selectively used to fit over the spline covering knob 200 and battery-powered turning can also be accomplished.

The open head 220 is quite similar to the embodiment shown in FIG. 4 except that the ears 208 and 210 of the knob 200 and the opposed lateral openings 222, 224 of the open head are machined to fit precisely together. Also, cylindrical surface 224 of the insert and the central cavity 226 of the open head fit nicely together. The open end of the device, too, has a rear wall 226 which, when the head is placed over the knob abuts against the exterior wall 228. Of course, the device is provided with a hex-shaped shank for connecting to the battery powered screwdriver.

While the present invention has been explained in relation to its preferred embodiment, it is to be understood that various modifications thereof will be apparent to those of ordinary skill in the art upon reading this specification. Therefore, it is to be understood that the invention disclosed herein is intended to cover all such modifications as fall within the scope of the appended claims.

I claim:

1. An accessory for a hand drill for facilitating turning of a crank handle of the opening mechanism for a casement-type window, the crank handle having a cylindrical connection portion and a lateral extension connected thereto, said lateral extension being smaller in width than the diameter of said cylindrical connection portion the accessory comprising:

(a) a hand drill connection means for removably connecting the accessory to a hand drill and for transmitting the torque power of said hand drill to said accessory and;

(b) a head end connected to said hand drill connection means adapted to contact and rotate said crank handle when said hand drill connection means is rotated by said hand drill; said head end being provided with a central cavity having a laterally extending opening, said central cavity adapted to fit over said cylindrical connection portion and said laterally extending opening being wide enough to allow said lateral extension of said crank handle to pass therethrough, and said laterally extending opening being at least as wide as said cylindrical connection portion of said crank handle.

2. An accessory as claimed in claim 1 wherein said hand drill connection means is hex-shaped shank.

3. An accessory as claimed in claim 1 wherein said lateral extension of said crank handle defines an angular orientation with respect to a center axis passing through said cylindrical connection portion and said central opening further comprises an inclined section matingly configured to the angular orientation and dimensions of said lateral extension of said crank handle.

4. An accessory as claimed in claim 1 wherein said lateral opening defines a pair of edges, said edges being rubber coated.

5. An accessory as claimed in claim 1, wherein said central opening is rubber coated.

* * * * *